US007681411B2

(12) United States Patent
DiLorenzo

(10) Patent No.: US 7,681,411 B2
(45) Date of Patent: Mar. 23, 2010

(54) ICE MAKING AND DISPENSING METHOD AND APPARATUS WITH INCREASED SANITATION

(76) Inventor: Thomas DiLorenzo, 310 Jefferson Ave., Bristol, PA (US) 19007

( * ) Notice: Subject to any disclaimer, the term of this patent is extended or adjusted under 35 U.S.C. 154(b) by 425 days.

(21) Appl. No.: 11/654,401

(22) Filed: Jan. 17, 2007

(65) Prior Publication Data

US 2007/0163283 A1 Jul. 19, 2007

Related U.S. Application Data

(60) Provisional application No. 60/759,511, filed on Jan. 17, 2006, provisional application No. 60/760,679, filed on Jan. 20, 2006.

(51) Int. Cl.
*F25C 1/12* (2006.01)

(52) U.S. Cl. ..... 62/347; 62/78; 417/313

(58) Field of Classification Search ..... 62/66–74, 62/78, 340–356; 417/313
See application file for complete search history.

(56) References Cited

U.S. PATENT DOCUMENTS 4,555,335 A * 11/1985 Burris ..... 210/192
4,824,563 A * 4/1989 Iwahori et al. ..... 210/195.1
5,005,364 A 4/1991 Nelson
5,184,633 A 2/1993 Langford
5,430,228 A 7/1995 Ciambrone et al.
5,458,851 A 10/1995 Schroeder et al.
5,586,439 A 12/1996 Schlosser et al.
5,709,799 A 1/1998 Engelhard
6,167,711 B1 * 1/2001 Slattery et al. ..... 62/78
6,287,515 B1 9/2001 Koosman et al.
6,334,328 B1 1/2002 Brill
6,506,428 B1 1/2003 Berge et al.
7,422,684 B1 * 9/2008 Davis et al. ..... 210/192

* cited by examiner

*Primary Examiner*—William E Tapolcai
(74) *Attorney, Agent, or Firm*—GrayRobinson, P.A.

(57) ABSTRACT

Disclosed is an ice making apparatus and method whereby the cleanliness of ice is improved through the use of ozone ($O_3$). The invention utilizes a volute aspirator that is positioned within the intake of a conventional sump pump. The vacuum generated by the pump draws upon both a supply of ozone and water, whereby the ozone is entrained within the water. The presence of the ozone within the water inhibits the growth of bacteria and other contaminates. The ozonated water is then used in the production of ice.

5 Claims, 2 Drawing Sheets

ICE MAKING AND DISPENSING METHOD AND APPARATUS WITH INCREASED SANITATION

RELATED APPLICATION DATA

This application claims priority to provisional application Ser. No. 60/759,511 filed Jan. 17, 2006 as well as provisional application Ser. No. 60/760,679 filed on Jan. 20, 2006 both of which are entitled "Sanitary Ice Making and Dispensing Apparatus." The contents of both these applications are incorporated herein by reference.

BACKGROUND OF THE INVENTION

1. Field of the Invention

This invention relates to an ice making apparatus with increased sanitation. More particularly, the present invention relates to an ice making apparatus and method that inhibits the grown of harmful microorganisms via ozone.

2. Description of the Background Art

The ice machine is one of the most common appliances in use today. These machines are commonly found in kitchens, restaurants, cafeterias, hospitals, nursing facilities, and convenience stores across the country. A widely employed construction situates the ice machine above an array of fountain drink dispensers. As is typical, this ice machine is coupled to an independent supply of water. This water is then routed over an evaporator. Due to the cooling effect of the evaporator, over time ice builds up upon the evaporator. This ice is then removed from the evaporator in cubes or flakes during a harvest cycle. The harvest cycle is generally accomplished by introducing a layer of warm air between the ice and evaporator, whereby the ice is melted a sufficient degree to allow it to slip off the evaporator. The collected ice is then stored within a bin and thereafter selectively removed so as to fill a cup or other such container. Typically, the ice is removed by pressing the container against a lever which actuates a bin opening.

Recently, attention has been drawn to the unsanitary condition of many commercial ice machines. Ice machines contain drains, pumps, hoses, evaporators and bins, all of which must be periodically cleaned and disinfected. All too often, however, ice machines are forgotten about and are never cleaned or otherwise maintained. As a result, the internal components become contaminated with bacteria, mold, or other undesirable contaminates. These contaminates are then ingested by unwary individuals consuming the ice.

As a result of the foregoing, numerous attempts have been made over the years to improve the sanitation within ice making machines. For example, U.S. Pat. No. 6,506,428 to Berge et al et al. discloses an ozone cleaning and sanitation method and apparatus for ice and ice conveyance systems. The apparatus includes an ozone generator. Ozone-rich air exiting the ozone generator is drawn through a conduit to a venturi where through aspiration it is incorporated into water circulating through a conduit. Water is circulated through the conduit via a circulation pump that is located downstream from the venturi.

Likewise, U.S. Pat. No. 6,334,328 to Brill discloses a sanitary ice making and dispensing apparatus. The device includes an ozone generator and an associated air pump for feeding ozone enriched air to the air inlet of a venturi. The venturi is used to entrain ozone into water that is pumped through the venturi by an upstream pump.

Finally, U.S. Pat. No. 6,287,515 to Koosman et al. discloses a cleaning and sanitizing assembly for clean in place food and beverage automatic dispensing machines. The assembly includes an ozone generator which introduces ozone into a water supply line.

Although each of the above referenced inventions achieves its individual objective, they all suffer from a common problem. Namely, none of the above referenced devices can be easily retrofitted upon an existing ice machine. Nor do the above referenced devices disclose utilizing a single pump to supply a vacuum to both water and ozone to thereby more efficiently entrain ozone within water. Finally, the above referenced inventions are needlessly complicated and necessarily include both a water pump and an air pump in order to combine the ozone and water. The present invention is aimed at overcoming the aforementioned deficiencies in the background art.

SUMMARY OF THE INVENTION

It is therefore one of the objectives of this invention to provide an apparatus and method for inhibiting the growth of microorganisms in ice making machines.

It is also an object of this invention to employ a water pump to draw a vacuum upon independent ozone and water supplies whereby ozone is efficiently entrained within the water.

Still another object of this invention is to utilize a volute aspirating system in the sanitary manufacture of ice.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The present invention relates to an ice making apparatus and method whereby the cleanliness of ice is improved through the use of ozone ($O_3$). The invention utilizes an injector that is positioned within the intake of a conventional sump pump. The vacuum generated by the pump draws upon both a supply of ozone and water, whereby the ozone is entrained within the water. The presence of the ozone within the water kills or otherwise inhibits the growth of bacteria and other contaminates. The ozonated water is then used in the production of ice.

Figure 1:
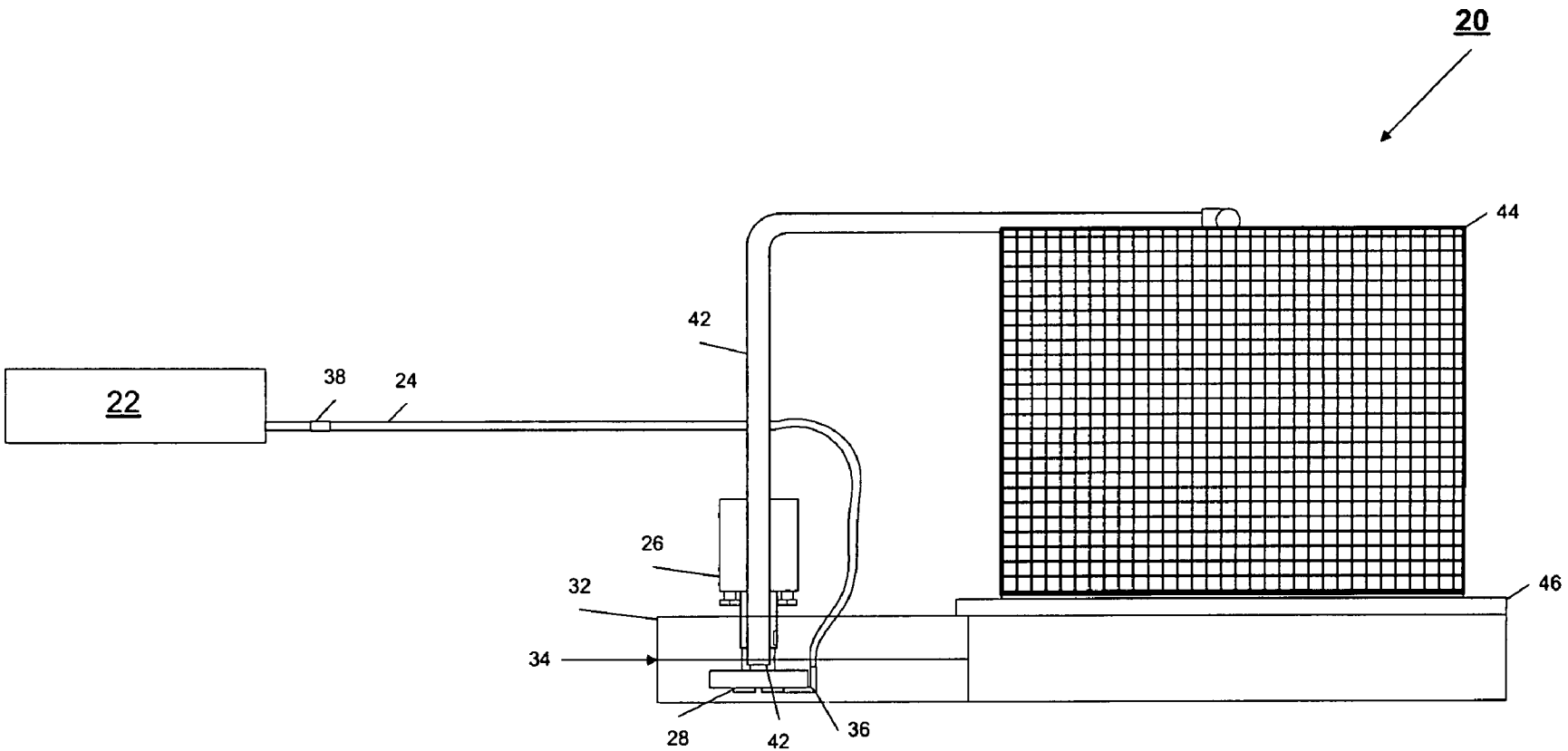
FIG. 1 is a side elevational view of the ice making system of the present invention.

With reference to FIG. 1, the system 20 of the present invention is depicted. System 20 includes a conventional ozone generator 22 which delivers a steady stream of ozone gas to an ozone transfer tube 24. System 20 further includes a conventional sump pump 26 with a conventional impeller (not shown). The preferred pump is manufactured by Hartel Pumps of Ivyland Pa. Pump 26 includes a lower intake end 28, or volute, that is adapted to be positioned within a sump pit 32 at a location below the water line 34.

Figure 4:
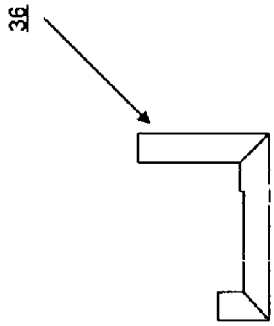
FIG. 4 is detailed view of the volute aspirating injector taken from FIG. 3.
Figure 3:
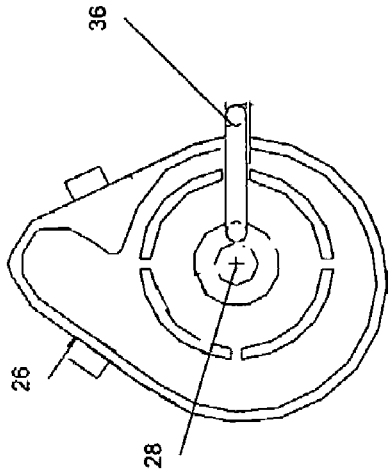
FIG. 3 is a view of the underside of the pump depicted in FIG. 2 and depicting the water inlet.
Figure 2:
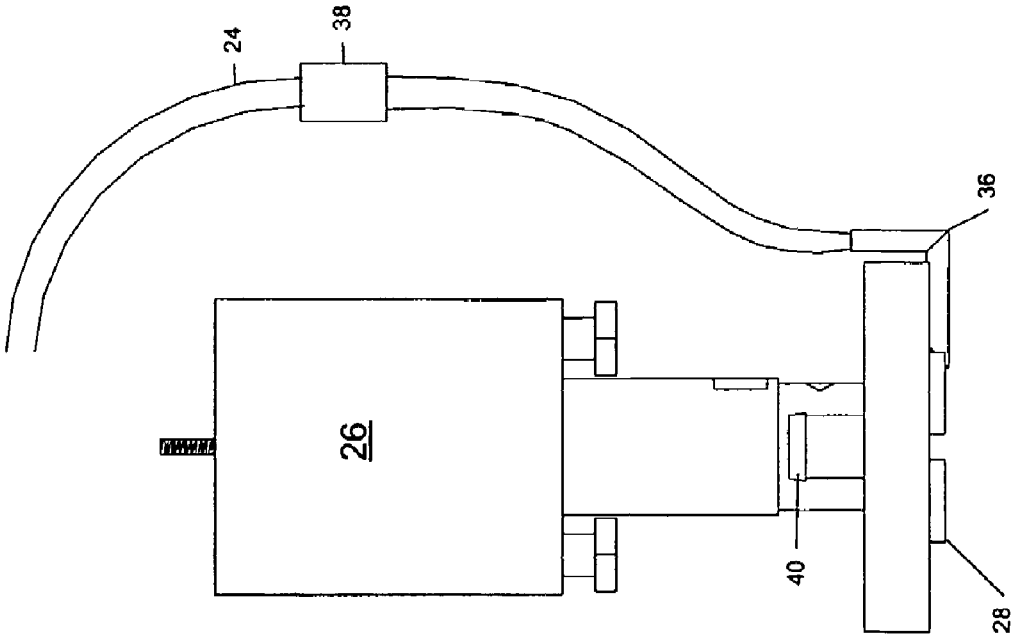
FIG. 2 is a side elevational view of the pump employed in the system depicted in FIG. 1.

Injector 36 connects the outlet of the ozone transfer tubing 24 to the inlet 28 of pump 26 (note FIG. 3). As noted by FIG. 4, injector 36 can take the form of an elbow type connector. Injector 36 is secured to the base plate of the pump adjacent the pump intake 28 via cement or any other suitable means of forming a permanent or semi-permanent connection. In order to ensure sufficient aspiration, the distal end of injector is located immediately adjacent the suction point of pump 26. In the preferred embodiment, injector 36 is formed from PVC and has an outside diameter of ¼". However, the use of other sized injectors that are formed from different materials is within the scope of the present invention.

A flow restrictor 38 can be located long the length of the transfer tubing 24 to regulate the amount of ozone delivered to the pump inlet 28. Transfer tubing is preferably formed from a vinyl tubing, which is both flexible and ozone friendly. The flow restrictor 38 is selected based upon the size of the ice machine being used and ensures that a proper amount of ozone is delivered to the pump via injector 36.

Ozone generator 22 is preferably a Poseidon brand ozone generator manufactured by Ozotech, Inc. of Yreka, Calif. This generator is a 12 volt (DC) generator that creates ozone via electrical arcing. Ozone generator 22 can optionally include a rheostat whereby the quantity of ozone being generated can be effectively controlled. A timer can also be associated with the generator to regulate when and how long it is on. Ozone generator 22 is preferably located within the cabinet associated with the ice machine to thereby limit the exposure of high voltage lines and conduits. Through the selection of flow restrictor 38, and by setting the timer and rheostat, a wide variety of ice machine capacities can be accommodated with a single ozone generator 22 and thereby avoid the under or over production of ozone. The production of too small amount of ozone may result in the less effective killing the bacteria and contaminates. Conversely, producing too much ozone results in ozone escaping from the ice machine, a phenomenon referred to as excessive out-gasing.

By way of a vacuum drawn by pump 26, water from pit 32 and ozone from injector 36 are combined and ozone becomes entrained within the water. Thereafter, the ozonated water is pumped through pump outlet 40 and upwardly through a water recirculation line 42. Water recirculation line is preferably formed from a vinyl tubing, which is both ozone friendly and flexible. The ozonated water is then delivered over the surface of an evaporator 44. As is widely known in ice making, evaporator 44 serves to cool the water flowing over its surface such that over time ice builds up upon the surface of the evaporator 44. This ice can then be harvested such that the ice is removed from evaporator 44 and collected as ice cubes. This ice is then stored within a bin for subsequent delivery as needed. A collection tray 46 is also included for collecting excess water passing over evaporator 44. This excess water is then delivered to sump pit 32 whereby it is re-circulated by pump 26.

Any bacteria or other contaminates within the water is effectively killed via the introduction of ozone. As a result the internal components of the ice machine are kept clean and the ice is free of bacteria or other contaminates. The use of ozone within water to kill bacteria is generally recognized as safe. Moreover, the effectiveness of ozone as a bactericide increases with colder water temperatures.

The system enhances the entraining of ozone into the circulated water by utilizing the sump pump 26 to draw a vacuum upon both the ozone supply and the water supply. As a result of this construction the use of an air pump is eliminated. Furthermore, because injector 36 sits below the water line, there is no need to utilize a check valve to prevent the back flow of water into the ozone generator. The present invention achieves ozone entrainment via a simple design that can be easily retrofitted to existing ice making equipment.

The simplicity of the present invention gives ice manufactures the flexibility of designing control circuits for any model of ice machine, and by any ice manufacturing company, utilizing a typical water pump and impeller design. The manufacturers have the ability to address the requirements of how much ice is produced and when. Logically speaking, a 400 lb ice machine with a 400 lb storage bin/dispenser given the same ozonation dosage as a 1300 lb ice machine on a 1000 lb storage bin would likely have problems with the out-gasing of ozone, which would be a major concern for many end users. An added benefit of timed on cycles during periods of no ice production will keep the system ozonated on a continuous basis and will extend the life of the generator while suppressing the likelihood of excess out-gassing. Whereas with proper dosage of ozonation, an acceptable level of outgas will sanitize the ice making compartment and will continue its downward flow to sanitize the storage bin continuing down through the drain. A modification to the drains has revealed that a barrier can easily be made to prevent *E. coli* from invading the ice making system. The system of the present invention with minor modifications greatly enhances the cleanliness of ice produced in every installation to date.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A sanitary ice making system comprising:

a sump pump with an internal impeller for drawing a vacuum, the pump having volute shaped inlet and an outlet;

a sump pit holding a supply of water, the inlet of the pump being located within the sump pit and beneath the water line, whereby water is drawn into the inlet of the pump;

an aspirating injector located immediately below the inlet of the pump;

an ozone generator for generating a supply of ozone gas, an ozone transfer line interconnecting the ozone generator to the aspirating injector, a flow restrictor located along the length of the ozone transfer line for regulating the flow of ozone, whereby ozone is delivered from the ozone generator to the volute shaped inlet of pump via the aspirating injector such that ozone becomes entrained within water being drawn into the inlet of pump;

an evaporator employed in creating ice;

a water recirculation line coupled to the outlet of the pump, the water recirculation line routing ozonated water from the outlet of the pump and over the evaporator whereby the ozonated water is used in the formation of ice.

2. A sanitary ice making system comprising:

a sump pump capable of drawing a vacuum, the sump pump having volute shaped inlet and an outlet;

a supply of water, the inlet of the sump pump positioned within the water, whereby water is drawn into the volute shaped inlet of the sump pump;

an ozone generator for generating a supply of ozone gas, an injector positioned immediately below the volute shaped inlet of the sump pump, an ozone transfer line interconnecting the ozone generator to the injector, whereby ozone becomes entrained within water being drawn into the inlet of pump via aspiration;

an evaporator employed in creating ice;

a water recirculation line coupled to the outlet of the pump, the water recirculation line routing ozonated water from the outlet of the pump and over the evaporator whereby the ozonated water is used in the formation of ice.

3. The system as described in claim 2 wherein the ozone is delivered to the inlet of the pump via an injector.

4. The system as described in claim 2 wherein a flow restrictor is located along the length of the ozone transfer line and wherein the amount of ozone delivered to the inlet of the pump is controlled by the flow restrictor.

5. The system as described in claim 2 where the pump is a sump pump.

* * * * *